US005174092A

United States Patent [19]

Naden

[11] Patent Number: 5,174,092

[45] Date of Patent: Dec. 29, 1992

[54] STEEL TILE ROOF

[76] Inventor: Robert W. Naden, 39880 Avenue 7 ½, Madera, Calif. 93638

[21] Appl. No.: 683,279

[22] Filed: Apr. 10, 1991

[51] Int. Cl.[5] ..... E04D 1/00

[52] U.S. Cl. ..... 52/553; 52/519; 52/538; 52/539; 52/542; 52/538; 52/560

[58] Field of Search ..... 52/519, 520, 521, 523, 52/533, 537, 538, 539, 541, 542, 553, 558, 559, 560

[56] References Cited

U.S. PATENT DOCUMENTS

| | | | |
|---|---|---|---|
| 351,956 | 11/1886 | Bennett | 52/542 |
| 1,414,774 | 5/1922 | De Julias | 52/537 |
| 1,434,166 | 10/1922 | Thompson . | |
| 1,473,275 | 1/1921 | Burgett . | |
| 1,555,087 | 6/1923 | Warren . | |
| 2,004,198 | 6/1935 | Fall | 52/553 |
| 2,021,929 | 11/1935 | Voigt | 52/521 |
| 2,362,236 | 11/1944 | Bassler | 52/521 |
| 2,482,835 | 9/1949 | Bremer | 52/533 |
| 3,058,265 | 10/1962 | Lapsensohn . | |
| 3,412,517 | 11/1968 | Ellis . | |
| 3,720,031 | 3/1973 | Wilson et al. | 52/520 |
| 4,327,528 | 5/1982 | Fritz | 52/539 X |
| 4,890,432 | 1/1990 | Shepherd | 52/539 X |

FOREIGN PATENT DOCUMENTS

| | | | |
|---|---|---|---|
| 0437064 | 12/1948 | Italy | 52/539 |
| 0005285 | 3/1897 | Norway | 52/537 |

*Primary Examiner*—Richard E. Chilcot, Jr.
*Assistant Examiner*—Robert Canfield
*Attorney, Agent, or Firm*—Poms, Smith, Lande & Rose

[57] ABSTRACT

A watertight and fire proof system for covering a roof is provided which comprises a plurality of tile elements which interlock in a horizontal direction relative the roof. The individual tiles can be interlocked and oriented relative each other to enable the selectable displacement of adjacent tile elements along a sloping direction of the roof which is perpendicular to the horizontal direction. An upper edge of a first one of the adjacent tile elements can be positioned at a different slope level of the roof relative an upper edge of a second one of the adjacent tile elements. Orientation of a first tile element relative a second tile element in the sloping direction is limited by contact between a lower flange of the first tile element and the abutting edge of the second tile element.

21 Claims, 1 Drawing Sheet

STEEL TILE ROOF

INTRODUCTION

Generally stated, the present invention relates to a system for covering a roof, and more particularly to a water tight and fire proof steel tile roofing system.

BACKGROUND OF THE INVENTION

The roofs of structures, such as buildings or houses, are constantly exposed to the environment which over time causes damage to the roofs and to the underlying structures. To prevent this damage, roofs are typically covered by a weatherproofing material. Tiles or shingles manufactured from a variety of materials, including wood and ceramic, are commonly selected as the preferred covering material. The tiles are generally attached to the roof in a horizontal pattern, with each alternating row being horizontally displaced by a percentage of a tile width. This pattern channels rain or snow away from the structure, and prevents moisture from getting under the tiles, where it can ultimately damage the structure. In addition to their weatherproof characteristics, some tiles are fire resistent. Another feature of wood or ceramic tile is that the arrangement can also be very attractive, forming a unique pattern of color to highlight the structure.

Despite these many advantages, tile roofs also have certain drawbacks. The biggest problem, is that the tile materials wear out due to constant exposure to the sun, wind, temperature variation and water. The tiles often become brittle or porous over time, wherein they lose their weatherproof characteristic. Replacement of the tiles is an often expensive proposition, since it is labor intensive to remove the old tiles and install the new ones. A second problem is that some of the materials, especially wood, can not be made fire resistent. Some communities have even attempted to ban the use of non-fire resistant materials for use on roofs. Because of these problems, owners of structures have long sought an improved roofing material.

Many of these problems can be solved through the use of a metal tile. Metal is far more durable than the previous roofing materials, and has superior fire resistance characteristics. However, metal tile roofs present two unique problems. First of all, a metal tile must generally be installed in rigid horizontal patterns, and can not easily be custom cut to fit. Adjacent tiles must be installed a fixed distance apart, and in near perfect vertical alignment. Thus, a roof having an irregular shape could not accept a metal tile, since the tiles could not be manipulated to cover the entire structure. A secondary problem with metal tile roofing systems is their appearance; while metal is an acceptable material for industrial structures, many homeowners would be reluctant to use metal, and prefer the more decorative aspects of wood or ceramic.

Therefore, it would be desirable to provide a metal tile roofing system which enables adjacent tiles to be oriented vertically and horizontally apart from each other, so as to adapt to uniquely shaped roofs. It would also be desirable to provide a metal tile roof material having an appearance with comparable aesthetic features as the conventional wood or ceramic tiles.

SUMMARY OF THE INVENTION

It is therefore a primary object of the present invention to provide a metal tile roofing system in which adjacent tiles can be manipulated in vertical orientation. It is also an object of the present invention to provide a metal tile roofing system which has the pleasing aesthetic features of a conventional wood or ceramic tile roofing system.

Generally stated, the present invention includes a plurality of trapezoidal metal tile elements, an attaching means for attaching the plurality of tile elements to a roof, and a laterally interlocking and vertically orienting means for interlocking laterally adjacent tile elements and orienting the relative vertical position of adjacent tile elements. Additionally, the material of the tile elements is selected to rapidly form a protective oxide coating upon exposure to outdoor elements, simulating the color and texture of decorative ceramic tiles.

A more complete understanding of the steel tile roofing system of the present invention will be afforded to those skilled in the art, as well as a realization of additional advantages and objects thereof, by a consideration of the following detailed description of a preferred exemplary embodiment. Reference will be made to the appended sheets of drawings which will be first described briefly.

DETAILED DESCRIPTION OF A PREFERRED EXEMPLARY EMBODIMENT

A preferred exemplary embodiment of a water tight and fire proof steel tile roofing system in accordance with the present invention, as illustrated in FIGS. 1 through 4, comprises a plurality of substantially horizontally arranged tile elements, an attaching means for attaching the plurality of tile elements to a roof, and an interlocking and orienting means for interlocking in a horizontal direction adjacent ones of the tile elements and orienting the relative position of the adjacent tile elements to enable selectable displacement of the adjacent tile elements relative each other along a sloping direction of the roof perpendicular to the horizontal direction. The present invention is shown attached to ar exemplary roof 12, which typically comprises flat sheets of plywood or other building materials covered by tar paper or other insulative material.

Figure 1:
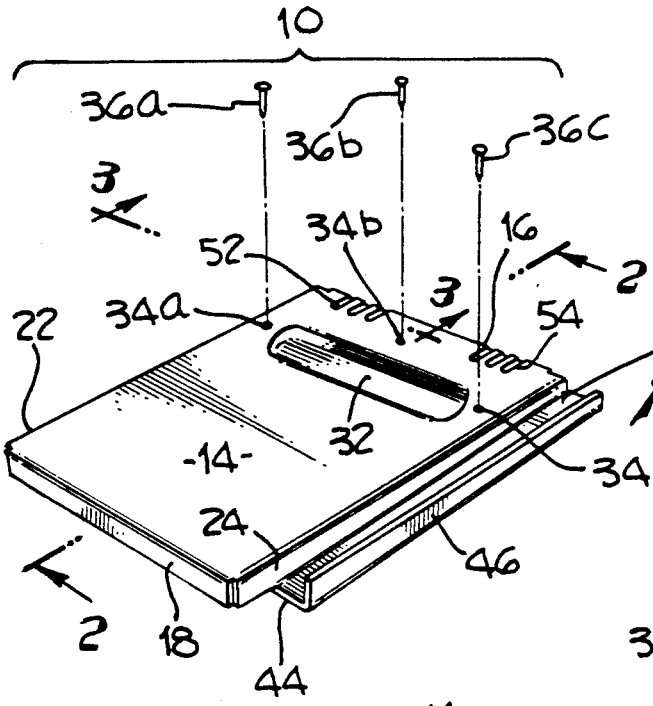
FIG. 1 is a perspective view of an exemplary steel tile of the present invention.

Referring first to FIG. 1, an individual tile element 10 is shown having trapezoidal surface 14, upper edge 16, depending lower flange 18, first depending side flange 22 and second depending side flange 24. It is anticipated that the entire tile element 10 of the present invention be made from a single sheet of material, which is cut into the desired shape by known machining processes. Trapezoidal surface 14 is substantially flat and provides the broad surface area which ultimately covers roof 12. Depending lower flange 18, first depending side flange 22 and second depending side flange 24 are each at right angles to trapezoidal surface 14, and are formed from the single sheet of material by known bending techniques. The width of both first depending side flange 22 and second depending side flange 24 taper from a maximum width at the end of trapezoidal surface 14 adjacent to depending lower flange 18 to a minimum width adjacent to upper edge 16. The width of lower flange 18 is constant across the breadth of trapezoidal surface 14, and is slightly larger than the maximum width of both depending side flanges 22 and 24. In an exemplary tile element 10, the width of the lower flange 18 is roughly equivalent to ⅝ inch.

Figure 2:
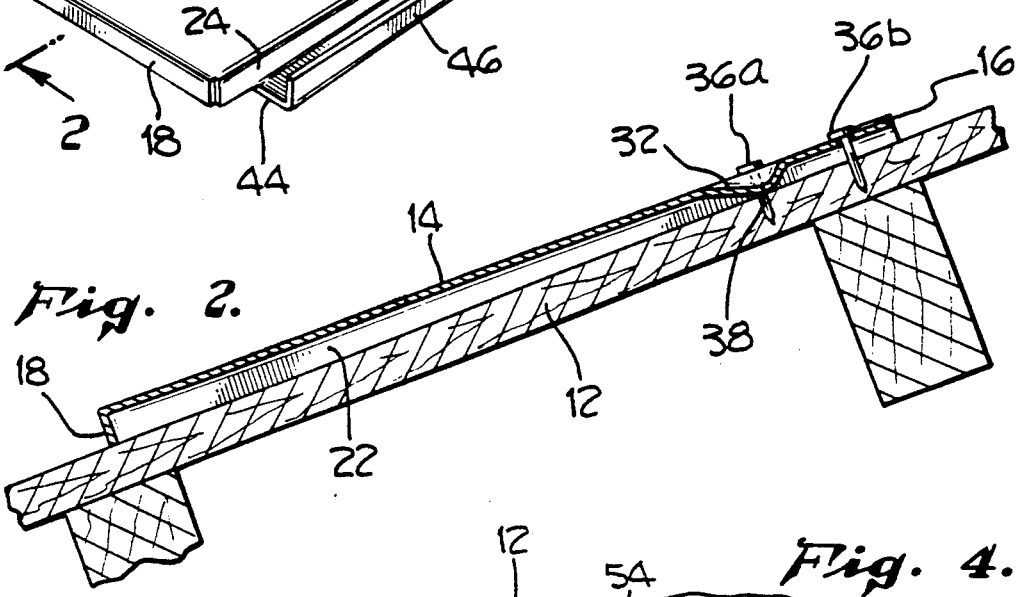
FIG. 2 is a sectional view of the exemplary steel tile attached to an exemplary roof, as revealed by the section 2—2 taken in FIG. 1.

The tapered depending side flanges 22 and 24 enable tile element 10 to rest on roof 12 such that a slight angle is formed between roof 12 and trapezoidal surface 14, as best shown in FIG. 2. This slight angle causes outdoor elements such as rain or snow to be deflected away from the roof. Depending lower flange 18 similarly prevents water from being forced beneath the exposed lower end of tile element 10 by wind.

The exemplary attaching means comprises a support indentation 32 and a plurality of nailing holes 34*a, b,* and *c*. The indentation is substantially centered in the trapezoidal surface 14 between the first and second depending side flanges 22 and 24, and proximate the upper edge 16. The indentation 32 depends from the trapezoidal surface 14 to provide a contact surface 38 with the roof 12, as best shown in FIG. 2. It is anticipated that common roofing nails 36*a, b* and *c* be driven through nail holes 34*a, b* and *c*, respectively, and into roof 12, to permanently affix the individual tile elements 10 to the roof 12.

The exemplary interlocking and orienting means comprises a channel element, shown generally at 40, integral to the second depending side flange 22. The channel element 40 extends from the upper edge 16 to a point intermediate the upper edge 16 and the lower flange 18. The element 40 further comprises a trough element 42 perpendicular to the second depending side flange 22, an abutting edge 44 at a lower end of the channel element 40, and an upstanding side edge flange 46. In an exemplary tile element 10, the width of trough element 42 is approximately 1½ inches. The upstanding side edge flange 46 tapers from a maximum width at the abutting edge 44 to a minimum width at the upper edge 16.

Figure 4:
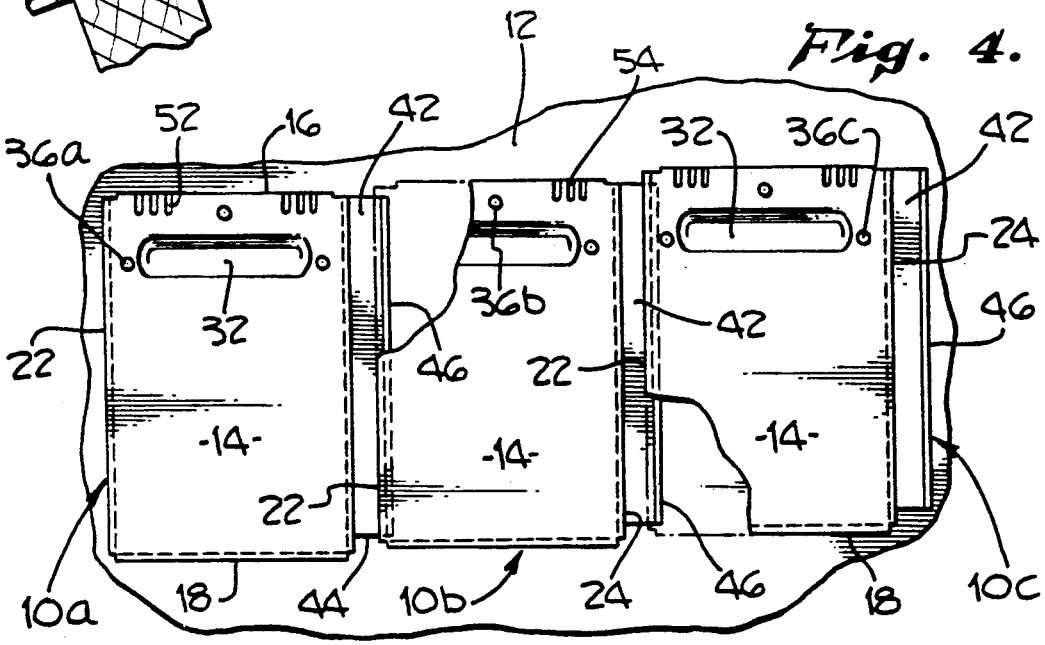
FIG 4 is a front view of a plurality of the exemplary steel tiles attached to an exemplary roof with each tile incrementally displaced in vertical orientation.

As shown in FIG. 4, adjacent ones of the tile elements are arranged so that a first depending side flange 22 of a first tile element 10*a* inserts into a trough element 42 of a second of said tile elements 10*b*. The first tile element 10*a* is selectively movable in the sloping direction relative the second tile element 10*b*. In an exemplary tile element, the displacement between lower flange 18 and abutting edge 44 along the length of second depending side 24 is approximately equal to the width of the lower flange 18. Orientation of the first tile element 10*a* in the sloping direction relative the second tile element 10*b* is thus limited by contact between the lower flange 18 of the first tile element 10*a* and the abutting edge 44 of the second tile element 10*b*. The width of trough element 42 additionally enables horizontal manipulation of adjacent tile elements.

Figure 3:
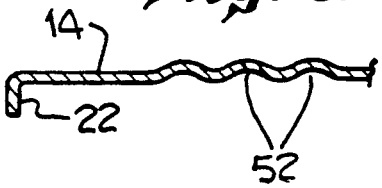
FIG 3 is a sectional view of the upper portion of an exemplary steel tile showing an exemplary corrugated section as revealed the section 3—3 taken in FIG. 1.

It is also anticipated that the tile element 10 of the present invention have first and second corrugated sections, shown at 52 and 54 of FIGS. 1 and 3. Each of the corrugated sections comprise a sinusoidal pattern imprinted into the upper area of trapezoidal surface 14 leading to upper edge 16. The corrugated sections 52 and 54 act to stiffen trapezoidal surface 14 and prevent warping.

It is further contemplated in the present invention that the material of the exemplary tile elements 10 be selected so as to rapidly form a protective oxide coating upon exposure to outdoor elements. This oxide coating would seal the points of contact between adjacent tile elements, to keep moisture from invading below the tile elements. Furthermore, the oxide coating would turn the color of the tile to a reddish brown shade, providing a pleasing appearance for the covered roof.

It is anticipated that rows of tile elements be arranged as shown in FIG. 4, such that the displacement of adjacent elements in both the horizontal direction and the sloping direction is varied. This arrangement enables the tile elements to completely cover roofs with unique dimensions. It is further anticipated that additional rows of tile elements overlay the upper portions of exposed tile element rows, as commonly known in the industry.

Having thus described a preferred exemplary embodiment of an improved steel tile roofing system, it should now be apparent to those skilled in the art that the aforestated objects and advantages for the within system have been achieved. It should also be appreciated by those skilled in the art that various modifications, adaptations and alternative embodiments thereof may be made within the scope and spirit of the present invention which is defined by the following claims.

I claim:

1. In a watertight and fire proof system for covering a roof comprising a plurality of tile elements which interlock in a horizontal direction, each having an upper edge, a depending lower flange, and a first and second depending side flange, said first and second depending side flanges tapering from a maximum width at said lower flange to the minimum at said upper edge, said lower flange having a width slightly greater than said maximum width of said side flanges, the improvement being:

an interlocking and orienting means for interlocking in said horizontal direction adjacent ones of said tile elements and orienting the relative position of said adjacent tile elements to enable selectable displacement of said adjacent tile elements relative each other along a sloping direction of said roof perpendicular to said horizontal direction;

whereby, an upper edge of a first one of said adjacent tile elements can be positioned at a different slope level of said roof relative an upper edge of a second one of said adjacent tile elements and orientation of said first tile element relative said second tile element in said sloping direction is limited by contact between said depending lower flange of said first tile element and said interlocking and orienting means of said second tile element.

2. The system of claim 1, wherein said interlocking and orienting means comprises:

a channel element integral to said second depending side flange, said channel element extending from said upper edge to a point intermediate said upper edge and said lower flange, said channel element further comprising a trough element perpendicular to said second depending side flange, an abutting edge at a lower end of said channel element, and an upstanding side edge flange, said upstanding side edge flange tapering from a maximum width at said abutting edge to a minimum width at said upper edge;

whereby adjacent ones of said tile elements are arranged so that a first depending side flange of a first tile element inserts into a trough element of a second of said tile elements, said first tile element being selectively movable in said sloping direction relative said second tile element.

3. The system of claim 2, wherein displacement between said lower flange and said abutting edge along said second depending side flange is approximately equal to the width of said lower flange.

4. The system of claim 3, wherein the material of said tile elements is selected to rapidly form a protective oxide coating upon exposure to outdoor elements.

5. The system of claim 4, wherein said material of said tile elements is steel.

6. A watertight and fire proof system for covering a roof comprising:

a plurality of tile elements arranged in a horizontal direction relative said roof;

an attaching means for attaching said plurality of tile elements to said roof;

an interlocking and orienting means for interlocking adjacent ones of said tile elements and orienting the relative position of said adjacent tile elements along a sloping direction of said roof perpendicular to said horizontal direction to enable selectable displacement of said adjacent tile elements relative each other;

whereby, an upper edge of a first one of said adjacent tile elements can be positioned at a different slope level of said roof relative an upper edge of a second one of said adjacent tile elements, and orientation of said first tile element relative said second tile element in said sloping direction is limited by contact between said first tile element and said interlocking and orienting means of said second tile element.

7. The system of claim 6, wherein each of said tile elements has a surface, an upper edge, a depending lower flange, and a first and second depending side flange, said first and second depending side flanges tapering from a maximum width at said lower flange to a minimum width at said upper edge, said lower flange having a width slightly greater than said maximum width of said depending side flanges.

8. The system of claim 7, wherein said attaching means comprises a support indentation and a plurality of nailing holes, said indentation being substantially centered in said surface between said depending side flanges and proximate said upper edge, said indentation depending from said surface to provide a contact surface with said roof.

9. The system of claim 8, wherein:

said interlocking and orienting means comprises a channel element integral to said second depending side flange, said channel element extending from said upper edge to a point intermediate said upper edge and said lower flange, said channel element further comprising a trough element perpendicular to said second depending side flange, an abutting edge at a lower end of said channel element, and an upstanding side edge flange, said upstanding side edge flange tapering from a maximum width at said abutting edge to a minimum width at said upper edge;

whereby adjacent ones of said tile elements are arranged so that said first depending side flange of a first of said tile elements inserts into said trough element of a second of said tile elements, said first tile element being selectively movable relative said second tile element in said sloping direction.

10. The system of claim 9, wherein displacement between said lower flange and said abutting edge along said side flange is approximately equal to said maximum width of said side flange.

11. The system of claim 10, wherein material of said tile elements is selected to rapidly form a protective oxide coating upon exposure to outdoor elements.

12. The system of claim 11, wherein said material of said tile elements is steel.

13. A watertight and first proof system for covering a roof comprising:

a plurality of tile elements arranged in a horizontal direction, each of said tile elements having a surface, an upper edge, a depending lower flange, and a first and second depending side flange, said first and second depending side flanges tapering from a maximum width at said lower flange to a minimum width at said upper edge, said lower flange having a width slightly greater than said maximum width of said depending side flanges;

an attaching means for attaching said plurality of tile elements to said roof, said attaching means comprising a support indentation and a plurality of nailing holes, said indentation being substantially centered in said surface between said depending side flanges and proximate said upper edge, said indentation depending from said trapezoidal surface to provide a contact surface with said roof; and an interlocking and orienting means for interlocking adjacent ones of said tile elements and orienting the relative position of said adjacent tile elements in a sloping direction perpendicular to said horizontal direction to enable selectable displacement of said adjacent tile elements relative each other, said interlocking and orienting means comprises a channel element integral to said second side flange, said channel element extending from said upper edge to a point intermediate said upper edge and said lower flange, said channel element further comprising a trough element perpendicular to said second depending side flanges, and abutting edge at a lower end of said channel element, and an upstanding side edge flange, said upstanding side edge flange tapering from a maximum width at said abutting edge to a minimum at said upper edge;

whereby adjacent ones of said tile elements are arranged so that said first depending side flange of a first tile inserts into said trough element of a second of said tile elements, said first tile element being selectively moveable along said sloping direction relative said second tile element, and orientation of said first tile element in said sloping direction relative said second tile element is limited by contact between said lower flange of said first tile element and said abutting edge of said second tile element.

14. The system of claim 13, wherein displacement between said lower flange and said abutting edge along said depending side flange is approximately equal to said maximum width of said second depending side flange.

15. The system of claim 14, wherein material of said tile elements is selected to rapidly form a protective oxide coating upon exposure to outdoor elements.

16. The system of claim 15, wherein said material of said tile elements is steel.

17. In a watertight and fire proof system for covering a roof comprising a plurality of tile elements which interlock in a horizontal direction, each having an upper edge, a depending lower flange, and a first and second depending side flange, said first and second depending side flanges tapering from a maximum width at said lower flange to a minimum width at said upper edge, said lower flange having a width slightly greater than said maximum width of said side flanges, the improvement being:

an interlocking and orienting means for interlocking in said horizontal direction adjacent ones of said tile elements and orienting the relative position of said adjacent tile elements to enable selectable displacement of said adjacent tile elements relative each other along a sloping direction of said roof perpendicular to said horizontal direction, whereby an upper edge of a first one of said adjacent tile elements can be positioned at a different slope level of said roof relative an upper edge of a second one of said adjacent tile elements;

said interlocking and orienting means further comprising a channel element integral to said second depending side flange, said channel element extending from said upper edge to a point intermediate said upper edge and said lower flange, said channel element further comprising a trough element perpendicular to said second depending side flange, an abutting edge at a lower end of said channel element, and an upstanding side edge flange, said upstanding side edge flange tapering from a maximum width at said abutting edge to a minimum width at said upper edge, whereby adjacent ones of said tile elements are arranged so that a first depending side flange of a first tile element inserts into a trough element of a second of said tile elements, said first tile element being selectively moveable in said sloping direction relative said second tile element;

wherein, displacement between said lower flange and said abutting edge along said second depending side flange is approximately equal to the width of said lower flange, an orientation of said first tile element relative said second tile element in said sloping direction is limited by contact between said lower flange of said first tile element and said abutting edge of said second tile element.

18. The system of claim 17, wherein material of said tile elements is selected to rapidly form a protective oxide coating upon exposure to outdoor elements.

19. The system of claim 18, wherein said material of said tile elements is steel.

20. A watertight and fire proof system for covering a roof comprising:

a plurality of tile elements arranged in a horizontal direction relative said roof, each of said tile elements having a surface, an upper edge, a depending lower flange, and a first and second depending side flange, said first and second depending side flanges tapering from a maximum width at said lower flange to a minimum width at said upper edge, said lower flange having a width slightly greater than said maximum width of said depending side flanges;

an attaching means for attaching said plurality of tile elements to said roof, said attaching means comprising a support indentation and a plurality of nailing holes, said indentation being substantially centered in said surface between said depending side flanges and proximate said upper edge, said indentation depending from said surface to provide a contact surface with said roof; and an interlocking and orienting means for interlocking adjacent ones of said tile elements and orienting the relative position of said adjacent tile elements along a sloping direction of said roof perpendicular to said horizontal direction to enable selectable displacement of said adjacent tile elements relative each other, said interlocking and orienting means comprises a channel element integral to said second depending side flange, said channel element extending from said upper edge to a point intermediate said upper edge and said lower flange, said channel element further comprising a trough element perpendicular to said second depending side flange, an abutting edge at a lower end of said channel element, and an upstanding side edge flange, said upstanding side edge flange tapering from a maximum width at said abutting edge to a minimum width at said upper edge, whereby adjacent ones of said tile elements are arranged so that said first depending side flange of a first of said tile elements inserts into said trough element of a second of said tile elements, said first tile element being selectively moveable relative said second tile element in said sloping direction;

whereby, an upper edge of a first one of said adjacent tile elements can be positioned at a different slope level of said roof relative an upper edge of a second one of said adjacent tile elements, and displacement between said lower flange and said abutting edge along said side flange is approximately equal to said maximum width of said side flange, and orientation of said first tile element relative said second tile element in said sloping direction is limited by contact between said lower flange of said first tile element and said abutting edge of said second tile element.

21. A watertight and fire proof system for covering a roof comprising:

a plurality of tile elements arranged in a horizontal direction, each of said tile elements having a surface, an upper edge, a depending lower flange, and a first and a second depending side flange, said first and second depending side flanges tapering from a maximum width at said lower flange to a minimum width at said upper edge, said lower flange having a width slightly greater than said maximum width of said depending side flanges;

an attaching means for attaching said plurality of tile elements to said roof, said attaching means comprising a support indentation and a plurality of nailing holes, said indentation being substantial centered in said surface between said depending side flanges and proximate said upper edge, said indentation depending from said trapezoidal surface to provide a contact surface with said roof; and an interlocking and orienting means for interlocking adjacent ones of said tile elements and orienting the relative position of said adjacent tile elements in a sloping direction perpendicular to said horizontal direction to enable selectable displacement of said adjacent tile elements relative each other, said interlocking and orienting means comprises a channel element integral to said second side flange, said channel element extending from said upper edge to a point intermediate said upper edge and said lower flange, said channel element further comprising a trough element perpendicular to said second depending side flanges, an abutting edge at a lower end of said channel element, and an upstanding side edge flange, said upstanding side edge flange tapering from a maximum width at said abutting edge to a minimum width at said upper edge;

whereby adjacent ones of said tile elements are arranged so that said first depending side flange of a first tile element inserts into said trough element of a second of said tile elements, said first tile element being selectively moveable along said sloping direction relative said second tile element, and displacement said lower flange and said abutting edge along said second depending said side flange is approximately equal to said maximum width of said depending side flange, and orientation of said first tile element in said sloping direction relative said second tile element is limited by contact between said lower flange of said first tile element and said abutting edge of said second tile element.

* * * * *